US005502350A

United States Patent [19]

Uehara et al.

[11] Patent Number: 5,502,350

[45] Date of Patent: Mar. 26, 1996

[54] SHADOW MASK SUPPORT MEMBER HAVING HIGH STRENGTH AND THERMAL DEFORMATION RESISTANT LOW-EXPANSION ALLOY PLATE AND HIGH EXPANSION ALLOY PLATE AND METHOD OF PRODUCING THE SAME

[75] Inventors: Toshihiro Uehara, Yasugi, Japan; Koji Sato, Berkeley, Calif.; Shuichi Nakamura, Yasugi, Japan

[73] Assignee: Hitachi Metals Ltd., Tokyo, Japan

[21] Appl. No.: 291,904

[22] Filed: Aug. 18, 1994

[51] Int. Cl.[6] ..... H01J 29/07

[52] U.S. Cl. ..... 313/404; 313/405

[58] Field of Search ..... 313/402, 404, 313/405, 407

[56] References Cited

U.S. PATENT DOCUMENTS

| | | | |
|---|---|---|---|
| 3,898,508 | 8/1975 | Pappadis | 313/405 |
| 4,315,189 | 2/1982 | Goto et al. | 313/405 |
| 4,613,785 | 9/1986 | Ragland | 313/405 |
| 4,792,719 | 12/1988 | Ornstein | 313/405 |
| 5,066,886 | 11/1991 | Harner | 313/404 |
| 5,394,052 | 2/1995 | Oh | 313/405 |

FOREIGN PATENT DOCUMENTS

| | | | |
|---|---|---|---|
| 0016442 | 1/1983 | Japan | 313/404 |
| 3-115543 | 5/1991 | Japan . | |

*Primary Examiner*—Sandra L. O'Shea
*Assistant Examiner*—Vip Patel
*Attorney, Agent, or Firm*—Sughrue, Mion, Zinn, Macpeak & Seas

[57] ABSTRACT

There is disclosed a shadow mask support member for supporting a shadow mask of a Braun tube which member comprises a parallel bonded-type bimetal, and has a high strength and an excellent resistance to thermal resistance. There is also disclosed a method of producing such a support member. The shadow mask support member includes a high-strength, low-expansion alloy plate, and a high-expansion alloy plate which are bonded together on their marginal surfaces, the low-expansion alloy plate having an excellent resistance to thermal deformation, the low-expansion alloy plate consisting essentially, by weight, of 0.1–0.5% C, not more than 1.0% Si, not more than 2.0% Mn, 30–40% Ni, 1.0–5.0% Mo and the balance Fe and incidental impurities, the low-expansion alloy plate having an average thermal expansion coefficient of not more than $6 \times 10^{-6}$/° C. at 30°–100° C. and a tensile strength of not less than 100 kgf/mm$^2$ at a room temperature, and the high-expansion alloy plate having an average thermal expansion coefficient of not less than $14 \times 10^{-6}$/° C. at 30°– 100° C. and a tensile strength of not less than 110 kgf/mm$^2$ at a room temperature. Optionally, the low-expansion alloy plate may further contain not more than 10.0% Cr and not more than 10.0% Co, and the content of (Ni+Co) is 30–40%.

11 Claims, 2 Drawing Sheets

SHADOW MASK SUPPORT MEMBER HAVING HIGH STRENGTH AND THERMAL DEFORMATION RESISTANT LOW-EXPANSION ALLOY PLATE AND HIGH EXPANSION ALLOY PLATE AND METHOD OF PRODUCING THE SAME

BACKGROUND OF THE INVENTION

This invention relates to a shadow mask support member (e.g. a spring comprising parallel bonded sheets) for supporting a shadow mask in a color Braun tube (cathode ray tube) so as to correct a color drift, and also relates to a method of producing such a support member.

In a color Braun tube of a television set, when a shadow mask is heated by electron beams, the shadow mask is thermally expanded to produce a color drift trouble. Therefore, there has heretofore been used a support member for resiliently support the shadow mask relative to a glass container, such a support member comprising a spring of a bimetal composed of two metal plates, which have thermal expansion coefficients different to each other, bonded parallel together on their marginal surfaces. Typically, such a spring has been formed by stamping and shaping a bimetal (or a trimetal) which has a low-expansion plate of an invar alloy (Fe-36Ni) and a high-expansion plate of austenitic stainless steel such as SUS304 (Fe-18Cr-8Ni).

Recently, with an increased size of television sets, there is a tendency for a Braun tube to increase in size and to become flatter. On the other hand, a shadow mask support member has been required to have a high-strength, compact design. In the case of the conventional parallel bonded-type bimetal formed by combining SUS 304 and a Fe-36% Ni invar alloy together, the tensile strengths of SUS304 and the invar alloy at a room temperature are about 120 kgf/mm$^2$ and about 80 kgf/mm$^2$, respectively, even if an aging treatment is effected after cold working. Particularly, the strength of the invar alloy is low. Thus, the conventional support member is not sufficiently high in strength to have a compact design, and therefore there has been encountered a problem that the support member can not be of a sufficiently small size. Under the circumstances, the parallel bonded-type bimetal, constituting the support member, has now been required to have a higher strength, and therefore the metal plates, constituting the parallel bonded-type bimetal, have been required to have a high strength.

When the shadow mask is to be incorporated into the Braun tube, the support member, while subjected to a strain, undergoes a heat history several times at temperatures ranging from 400° C. to 600° C. If the support member is formed into a small size, there is a possibility that the support member is permanently deformed by the heat of this heat history. The support member, constituted by the conventional parallel bonded-type bimetal (i.e., the combination of SUS304 and the Fe36%Ni invar alloy), does not possess a sufficient resistance to thermal deformation, and therefore there has been encountered a problem that the support member can not have a small-size design. Therefore, the parallel bonded-type bimetal, constituting the support member, has also been required to have an excellent resistance to thermal deformation, and to achieve this, it has been desired that the metal plates, constituting the parallel bonded-type bimetal, should have an excellent resistance to thermal deformation.

As described above, in order that the Braun tube can have a large-size, flat design, there has been a demand for the type of shadow mask support member having a high strength and an excellent resistance to thermal deformation.

SUMMARY OF THE INVENTION

It is an object of this invention to provide a shadow mask support member having a high strength and an excellent resistance to thermal resistance, the support member being formed by bonding a high-strength, low-expansion alloy plate (having a high strength and an excellent thermal deformation resistance) and a high-expansion alloy plate (having a high strength) together.

In order to impart a high strength to a shadow mask support member, it is necessary that both of two metal plates (that is, a high-expansion metal plate and a low-expansion metal plate), constituting this support member, should be increased in strength. Therefore, it has been thought effective particularly to increase the strength of the one of the two metal plates of the conventional parallel bonded-type bimetal having a lower strength, that is, the Fe-36%Ni invar alloy. A study of the resistance of the Fe-36%Ni invar alloy (which defines the low-expansion material of the conventional parallel bonded-type bimetal) to thermal deformation has indicated that its thermal deformation resistance is very poor, and therefore it has also been found necessary to enhance its resistance to thermal deformation.

In view of the foregoing, the inventors of the present invention have made an extensive study of Fe-Ni invar alloys in order to obtain an alloy having a high tensile strength at a room temperature, a low average thermal expansion coefficient at 30°–100° C., and a good thermal deformation resistance at 400°–600° C., and as a result there have been obtained the following findings based on which the present invention has been made. More specifically, it has been newly found that by the addition of C, Cr and Mo to a Fe-Ni invar alloy, the tensile strength at a room temperature, as well as the thermal deformation resistance at 400°–600° C., can be greatly enhanced, and that by suitably balancing the (Ni +Co) content, the average thermal expansion coefficient at 30°–100° C. can be kept low.

It has been newly found that these properties required for the low-expansion material of the shadow mask support member, such as a high strength, a low thermal expansion property and an excellent thermal deformation resistance, can be obtained by optimizing conditions of cold working and an aging treatment.

Further, it has been found that when a high-expansion alloy plate of Fe-high Mn-Cr-Ni-N or Fe-Mn-Ni-V-(Cr, Mo, W) is combined with the above low-expansion alloy plate, there can be obtained a shadow mask support member more excellent in thermal deformation resistance.

More specifically, according to a first aspect of the present invention, there is provided a shadow mask support member comprising a high-strength, low-expansion alloy plate, and a high-expansion alloy plate which are bonded together on their marginal surfaces, the low-expansion alloy plate having an excellent resistance to thermal deformation, the low-expansion alloy plate consisting essentially, by weight, of 0.1–0.5% C, not more than 1.0% Si, not more than 2.0% Mn, 30–40% Ni, 1.0–5.0% Mo and the balance Fe and incidental impurities, the low-expansion alloy plate having an average thermal expansion coefficient of not more than $6\times 10^{-6}$/° C. at 30°–100° C. and a tensile strength of not less than 100 kgf/mm$^2$ at a room temperature, and the high-expansion alloy plate having an average thermal expansion coefficient of not less than $14\times10^{-6}$/° C. at 30°–100° C. and a tensile strength of not less than 110 kgf/mm$^2$ at a room temperature.

According to a second aspect of the present invention, there is provided a shadow mask support member comprising a high-strength, low-expansion alloy plate, and a high-expansion alloy plate which are bonded together on their marginal surfaces, the low-expansion alloy plate having an excellent resistance to thermal deformation, the low-expansion alloy plate consisting essentially, by weight, of 0.1–0.5% C, not more than 1.0% Si, not more than 2.0% Mn, not more than 10.0% Cr, 30–40% Ni, 1.0–5.0% Mo and the balance Fe and incidental impurities, the low-expansion alloy plate having an average thermal expansion coefficient of not more than $10\times10^{-6}$/° C. at 30°–100° C. and a tensile strength of not less than 100 kgf/mm$^2$ at a room temperature, and the high-expansion alloy plate having an average thermal expansion coefficient of not less than $14\times10^{-6}$/° C. at 30°–100° C. and a tensile strength of not less than 110 kgf/mm$^2$ at a room temperature.

According to a third aspect of the present invention, there is provided a shadow mask support member comprising a high-strength, low-expansion alloy plate, and a high-expansion alloy plate which are bonded together on their marginal surfaces, the low-expansion alloy plate having an excellent resistance to thermal deformation, the low-expansion alloy plate consisting essentially, by weight, of 0.1–0.5% C, not more than 1.0% Si, not more than 2.0% Mn, 30–40% Ni, not more than 10.0% Co, 1.0–5.0% Mo and the balance Fe and incidental impurities, Ni+Co being 30–40%, the low-expansion alloy plate having an average thermal expansion coefficient of not more than $6\times10^{-6}$/° C. at 30°–100° C. and a tensile strength of not less than 100 kgf/mm$^2$ at a room temperature, and the high-expansion alloy plate having an average thermal expansion coefficient of not less than $14\times10^{-6}$/° C. at 30°–100° C. and a tensile strength of not less than 110 kgf/mm$^2$ at a room temperature.

According to a 4th aspect of the present invention, there is provided a shadow mask support member comprising a high-strength, low-expansion alloy plate, and a high-expansion alloy plate which are bonded together on their marginal surfaces, the low-expansion alloy plate having an excellent resistance to thermal deformation, the low-expansion alloy plate consisting essentially, by weight, of 0.1–0.5% C, not more than 1.0% Si, not more than 2.0% Mn, not more than 10.0% Cr, 30–40% Ni, not more than 10.0% Co, 1.0–5.0% Mo and the balance Fe and incidental impurities, Ni+Co being 30–40%, the low-expansion alloy plate having an average thermal expansion coefficient of not more than $10\times10^{-6}$/° C. at 30°–100° C. and a tensile strength of not less than 100 kgf/mm$^2$ at a room temperature, and the high-expansion alloy plate having an average thermal expansion coefficient of not less than $14\times10^{-6}$/° C. at 30°–100° C. and a tensile strength of not less than 110 kgf/mm$^2$ at a room temperature.

According to a 5th aspect of the present invention, there is provided a shadow mask support member comprising a high-strength, low-expansion alloy plate as defined in any one of the 1st to 4th aspects of the invention, and a high-expansion alloy plate which are bonded together on their marginal surfaces, the high-expansion alloy plate consisting essentially, by weight, of not more than 0.2% C, not more than 1.0% Si, 10–20% Mn, 10–20% Cr, 2–10% Ni, not more than 0.4% N and the balance Fe and incidental impurities, and the high-expansion alloy plate having an average thermal expansion coefficient of not less than $14\times10^{-6}$/° C. at 30°–100° C. and a tensile strength of not less than 110 kgf/mm$^2$ at a room temperature.

According to a 6th aspect of the present invention, there is provided a shadow mask support member comprising a high-strength, low-expansion alloy plate as defined in any one of the 1st to 4th aspects of the invention, and a high-expansion alloy plate which are bonded together on their marginal surfaces, the high-expansion alloy plate consisting essentially, by weight, of not more than 0.2% C, not more than 1.0% Si, 10–20% Mn, 10–20% Cr, 2–10% Ni, not more than 0.4% N, at least one selected from the group consisting of not more than 3.0% Mo and not more than 1.0% V, and the balance Fe and incidental impurities, and the high-expansion alloy plate having an average thermal expansion coefficient of not less than $14\times10^{-6}$/° C. at 30°–100° C. and a tensile strength of not less than 110 kgf/mm$^2$ at a room temperature.

According to a 7th aspect of the present invention, there is provided a shadow mask support member comprising a high-strength, low-expansion alloy plate as defined in any one of the 1st to 4th aspects of the invention, and a high-expansion alloy plate which are bonded together on their marginal surfaces, the high-expansion alloy plate consisting essentially, by weight, of 0.2–1.0% C, not more than 1.0% Si, 2–10% Mn, 8–20% Ni, 0.1–1.5% V, at least one selected from the group consisting of not more than 6.0% Cr, not more than 4% Mo and not more than 4% W, and the balance Fe and incidental impurities, and the high-expansion alloy plate having an average thermal expansion coefficient of not less than $16\times10^{-6}$/° C. at 30°–100° C. and a tensile strength of not less than 110 kgf/mm$^2$ at a room temperature.

According to an 8th aspect of the present invention, there is provided a shadow mask support member comprising a high-strength, low-expansion alloy plate as defined in any one of the 1st to 4th aspects of the invention, and a high-expansion alloy plate which are bonded together on their marginal surfaces, the high-expansion alloy plate consisting essentially, by weight, of 0.2–1.0% C, not more than 1.0% Si, 2–10% Mn, 8–20% Ni, 0.1–1.5% V, not more than 0.1% N, at least one selected from the group consisting of not more than 6.0% Cr, not more than 4% Mo and not more than 4% W, and the balance Fe and incidental impurities, and the high-expansion alloy plate having an average thermal expansion coefficient of not less than $16\times10^{-6}$/° C. at 30°–100° C. and a tensile strength of not less than 110 kgf/mm$^2$ at a room temperature.

According to a 9th aspect of the present invention, there is provided a shadow mask support member comprising a high-strength, low-expansion alloy plate as defined in any one of the 1st to 4th aspects of the invention, and a high-expansion alloy plate which are bonded together on their marginal surfaces, the high-expansion alloy plate consisting essentially, by weight, of 0.2–1.0% C, not more than 1.0% Si, 2–10% Fin, 8–20% Ni, 0.1–1.5% V, not more than 0.5% Nb, at least one selected from the group consisting of not more than 6.0% Cr, not more than 4% Mo and not more than 4% W, and the balance Fe and incidental impurities, and the high-expansion alloy plate having an average thermal expansion coefficient of not less than $16\times10^{-6}$/° C. at 30°–100° C. and a tensile strength of not less than 110 kgf/mm$^2$ at a room temperature.

According to a 10th aspect of the present invention, there is provided a shadow mask support member comprising a high-strength, low-expansion alloy plate as defined in any one of the 1st to 4th aspects of the invention, and a high-expansion alloy plate which are bonded together on their marginal surfaces, the high-expansion alloy plate consisting essentially, by weight, of 0.2–1.0% C, not more than 1.0% Si, 2–10% Mn, 8–20% Ni, 0.1–1.5% V, not more than 0.5% Nb, not more than 0.1% N, at least one selected from the group consisting of not more than 6.0% Cr, not more than 4% Mo and not more than 4% W, and the balance Fe and incidental impurities, and the high-expansion alloy plate having an average thermal expansion coefficient of not less than $16\times10^{-6}$/° C. at 30°–100° C. and a tensile strength of not less than 110 kgf/mm$^2$ at a room temperature.

According to an 11th aspect of the present invention, there is provided a method of producing a shadow mask support member having an excellent resistance to thermal deformation, comprising the steps of:

cold working a high-strength, low-expansion alloy plate as defined in any one of claims 1 to 4 at a reduction of not less than 40%, and subsequently subjecting the low-expansion alloy plate to an aging treatment at a temperature not more than 650° C.; and subsequently bonding the low-expansion alloy plate to a high-expansion alloy plate on their marginal surfaces.

As described above, one of the most significant features of the support member of the present invention is that the low-expansion alloy plate and the high-expansion alloy plate both have a high tensile strength of not less than 100–110 kgf/mm$^2$, and are bonded or joined together on their marginal surfaces by welding or the like to form the shadow mask support member. Such a combination has never been known or proposed in the prior art, and this support member is totally novel.

Effects of the elements of the low-expansion alloy of the support member of the present invention will now be described.

C is a very effective element which is, together with Cr and Mo, in a solid-solution state in the alloy of the invention to greatly enhance cold work hardenability, thereby increasing the strength at a room temperature, and also during the aging treatment, C forms carbides together with Cr and Mo, and finely precipitates, thereby increasing the strength at high temperatures to greatly enhance a thermal deformation resistance necessary for the material constituting the shadow mask support member. The C content should be at least 0.1%, but the addition of C in an excessive amount not only invites an increased thermal expansion coefficient, but also forms coarse carbides to adversely affect the cold workability. Therefore, this content should be not more than 0.5%.

Si is added in a small amount as a deoxidizer. The addition of this substance in an excessive amount lowers ductility, and therefore this content has been decided to be not more than 1.0%.

Mn is also added in a small amount as a deoxidizer. The addition of this substance in an excessive amount increases the thermal expansion coefficient, and therefore this content has been decided to be not more than 2.0%.

Ni is a very important element for obtaining a low thermal expansion property, and need to be added in an amount of 30–40% in order to maintain the low thermal expansion property required for the low-expansion material of the shadow mask support member. If the Ni content is less than 30%, a martensite transformation temperature rises, so that the martensite transformation is liable to occur during the cold working, and the thermal expansion coefficient rises. In contrast, if this content is more than 40%, the thermal expansion coefficient at lower temperatures rises although the inflection temperature rises. Thus, in either case, the intended low thermal expansion property can not be obtained, and therefore this content should be 30–40%.

Mo, when added in combination with C, enhances the hardenability by the cold working to increase the strength. Moreover, Mo is a very important element for greatly enhancing the thermal deformation resistance required for the shadow mask support member. It is thought that this is attributable to a mutual action between Mo and C in the solid solution state and also to the precipitation of fine carbides of a part of Mo. The Mo content need to be at least 1.0%, but the addition of Mo in an amount of more than 5.0% forms a large amount of carbides to lower the ductility. Therefore, the Mo content should be 1.0–5.0%.

In the alloy of the invention, it is not always necessary to add Cr. However, the addition of this substance is quite effective in enhancing the thermal deformation resistance required for the shadow mask support member. If this content is more than 10.0%, the austenitic structure becomes unstable, and the thermal expansion coefficient becomes too high. Therefore, the Cr content should be not more than 10.0%.

Co, like Ni, is an effective element for obtaining the low thermal expansion property, and its effect is greater than that of Ni. If Co is added in an amount of more than 10%, the martensite transformation temperature rises although the inflection temperature is not changed so much, so that a martensite transformation liable to occur during the cold working, and the thermal expansion coefficient rises. Therefore, this content should be not more than 10%. Moreover, Co achieves a similar effect, as attained by Ni, for obtaining the low thermal expansion property, and therefore can substitute for Ni in an equivalent amount, and hence an arrangement can be made in terms of the (Co+Ni) content. If the (Co+Ni) content is less than 30%, the martensite transformation temperature rises, so that a martensite transformation is liable to occur during the cold working, and the thermal expansion coefficient rises. In contrast, if this content is more than 40%, the thermal expansion coefficient at the lower temperatures rises. In either case, the intended low thermal expansion property can not be obtained, and therefore this content should be 30–40%.

The tensile strength need to be high so as to impart a high strength to the shadow mask support member. Further, the shadow mask support member need to have an excellent thermal deformation resistance in addition to a high tensile strength. In order to impart an excellent thermal deformation resistance to the shadow mask support member, the low-expansion alloy of the support member of the invention, having an excellent thermal deformation resistance, first need to be used instead of the conventional low-expansion alloy (Fe36%Ni alloy), and then the tensile strength level need to be increased. The tensile strength can be greatly increased by cold working the low-expansion alloy of the support member of the invention. It is advantageous that the tensile strength of the low-expansion alloy of the support member of the invention be higher than that of the conventional low-expansion alloy (the Fe-36% Ni invar alloy), and therefore the tensile strength of the low-expansion alloy of the invention has been decided to be not less than 100 kgf/mm$^2$.

In the shadow mask support member, the thermal expansion coefficient is significant in the range of from a room temperature to 100° C. at the most. In order that the shadow mask support member can operate to correct a color drift by the difference in thermal expansion between the two metal plates constituting the shadow mask support member, the low-expansion material has been decided to have a thermal expansion coefficient (the average value in the range of from a room temperature to 100° C.) of not more than $10\times10^{-6}$/° C. Preferably, this thermal expansion coefficient is not more than $6\times10^{-6}$/° C.

Where other deoxidizing elements, such as Al, Ti, Mg, Ca and B, are incidentally contained as impurities, or added in a trace amount, they will not affect the properties at all in so far as their content is in the following range, and therefore this falls within the range of the present invention.

Al, Ti≦0.1%

Mg, Ca, B≦0.02%

Next, a method of producing the low-expansion alloy of the support member of the invention will now be described.

The low-expansion alloy of the support member of the invention, having a composition falling within the range of the present invention, is first prepared, and the cold working is effected for enhancing the tensile strength at a room temperature and the thermal deformation resistance. Even if the composition of the low-expansion alloy of the present support member falls within the range of the invention, an adequate tensile strength can not be obtained if the reduction is less than 40%. Therefore, the reduction should be not less than 40%.

The aging treatment after the cold working is carried out for the purpose of enhancing the tensile strength, the tensile ductility, the thermal deformation resistance and the spring property. However, if the aging treatment is effected at a temperature of more than 650° C., the tensile strength at a room temperature is greatly lowered. Therefore, the aging treatment should be carried out at not more than 650° C.

The shadow mask support member, formed by bonding the low-expansion alloy plate, produced by this method, and the high-expansion alloy plate together on their marginal surfaces by welding or the like, has a high tensile strength and an excellent thermal deformation resistance, and is suitable for a large-size design of a Braun tube and a flat face-design thereof.

Next, effects of the elements of the high-expansion alloy of the support member of the invention, recited in claims 5 and 6, will now be described.

C is present in the solid-solution state in the austenitic matrix to strengthen the matrix. However, if this substance is added in an amount of more than 0.2%, this decreases the solid solubility of N, thus affecting the solid solution of N which is effective in enhancing the thermal deformation resistance. Therefore, this content should be not more than 0.2%.

Si is added in a small amount as a deoxidizer. However, the addition of this substance in an excessive amount lowers the ductility, and therefore this content has been decided to be not more than 1.0%.

Mn is an important element which increases the solid solubility of N to enhance the strength at a room temperature and the thermal deformation resistance, and also stabilizes the austenitic matrix to maintain a high thermal expansion property. However, if this content is less than 10%, the solid solubility of N is not adequate, and in contrast if this content is more than 20%, the workability is adversely affected. Therefore, this content should be 10–20%.

Cr is an important element which, like Mn, increases the solid solubility of N to enhance the strength at a room temperature and the thermal deformation resistance. If this content is less than 10%, the solid solubility of N is not adequate, and in contrast if this content is more than 20%, the austenitic matrix becomes unstable, and the thermal expansion coefficient is lowered. Therefore, this content should be 10–20%.

Not less than 2% Ni is necessary for stabilizing the austenitic matrix to obtain a high thermal expansion coefficient as described above for Mn. If this content is more than 10%, the solid solubility of N is lowered to lower the strength at a room temperature and the thermal deformation resistance. Therefore, this content should be 2–10%.

N is an important element which is contained in the solid solution state in the austenitic matrix to stabilize the austenite to increase the thermal expansion coefficient, and also greatly contributes to the strengthening of the solid solution to greatly improve the strength at a room temperature and particularly the thermal deformation resistance. If this content is more than 0.4%, the castability and weldability are adversely affected, and therefore this content should be not more than 0.4%.

V and Mo are present in the solid solution state in the austenitic matrix, or precipitates as fine carbides in the austenitic matrix, thereby further enhancing the thermal deformation resistance. One or both of the two elements can be added according to the need. If the content of V is more than 1.0%, it forms coarse primary carbides to adversely affect the workability. If the content of Mo is more than 3%, it makes the austenitic matrix unstable to lower the thermal expansion coefficient. Therefore, the V content should be not more than 1.0%, and the Mo content should be not more than 3.0%.

In the shadow mask support member, the thermal expansion coefficient is significant in the range of 30°–100° C. at the most. In order that the shadow mask support member can operate to correct a color drift by the difference in thermal expansion between the two metal plates constituting the shadow mask support member, the high-expansion material has been decided to have a thermal expansion coefficient (the average value in the range of from 30°–100° C.) of not less than $14\times10^{-6}$/° C.

It is preferred that the tensile strength be high to impart a high strength to the shadow mask support member, and if the high-expansion alloy plate is greater in strength than the low-expansion alloy plate, the shadow mask support plate can be further increased in strength. Therefore, the tensile strength of the high-expansion alloy has been decided to be not less than 110 kgf/mm$^2$.

Next, effects of the elements of the high-expansion alloy of the support member of the invention, recited in claims 7 to 10, will now be described.

C is very effective in stabilizing the austenitic structure to maintain the high-expansion property, and also is very effective in greatly enhancing the cold work hardenability to increase the strength at a room temperature, and further forms carbides together with V, Cr, Mo and W, and finely precipitates to increase the strength at high temperatures, thereby greatly enhancing the thermal deformation resistance required for the material constituting the shadow mask support member. To achieve these effects, C need to be added in an amount of not less than 0.2%. However, if this content is more than 1.0%, coarse primary carbides are formed to lower the ductility, thereby adversely affecting the workability of the material and the shaping ability of the shadow mask support member. Therefore, this content should be 0.2–1.0%.

Si is added in a small amount as a deoxidizer. If this substance is added in an excessive amount, the ductility is lowered, and therefore this content has been decided to be not more than 1.0%.

Mn is very effective in stabilizing the austenitic structure to maintain the high-expansion property, and also is effective in greatly enhancing the cold work hardenability to increase the strength at a room temperature. If this content is less than 2%, its effect is not satisfactory, and in contrast if this content is more than 10%, the hot workability as well as the oxidation resistance during the heat treatment are adversely affected greatly. Therefore, this content should be 2–10%.

Ni is most effective and essential for stabilizing the austenitic structure to maintain the high thermal expansion property. If this content is less than 8%, its effect is not satisfactory, and in contrast if this content is more than 20%, the austenitic structure is stabilized too much to lower the hardenability during the cold working, thus failing to provide a sufficiently high strength at a room temperature. Therefore, this content should be 8–20%.

V is an effective element which forms primary carbides to thereby make the crystal grains fine to increase the strength at a room temperature, and also is partially contained in the solid solution state in the austenitic matrix, or precipitates as fine carbides in the austenitic matrix during the aging treatment, thereby enhancing the thermal deformation resistance and the strength at a room temperature. If this content is less than 0.1%, the above effects are not satisfactory, and in contrast if this content is more than 1.5%, a large amount of coarse primary carbides are formed to adversely affect the workability of the material and the shaping ability of the shadow mask support member. Therefore, this content should be 0.1–1.5%.

Cr, Mo and W are effective elements which are contained in the solid solution state in the austenitic matrix, or precipitate as fine carbides in the austenitic matrix during the aging treatment, thereby increasing the strength at a room temperature and particularly greatly enhancing the thermal deformation resistance. At least one selected from the group consisting of these elements is added. However, all of these are ferrite-forming elements, and therefore if the Cr content is more than 6.0%, the Mo content is more 4.0%, and the W content is more than 4.0%, the austenitic matrix becomes unstable, which makes it difficult to maintain the high thermal expansion property. Therefore, the Cr content should be not more than 6.0%, the Mo content should be not more than 4.0%, and the W content should be not more than 4.0%.

Nb is an effective element which forms primary carbides to thereby make the crystal grains fine to increase the strength at a room temperature. This element can be suitably added according to the need. However, if this content is more than 0.5%, a large amount of coarse primary carbides are formed to adversely affect the workability of the material and the shaping ability of the shadow mask support member. Therefore, this content should be not more than 0.5%.

N is an effective element which is contained in the solid solution state in the austenitic matrix to solid-solution-strengthen the austenitic matrix, thereby increasing the strength at a room temperature and particularly enhancing the thermal deformation resistance. This element can be added according to the need, but if this content is more than 0.1%, the weldability is adversely affected. Therefore, this content should be not more than 0.1%.

In the present invention, the high-strength, low-expansion alloy plate with an excellent thermal deformation resistance and the high-expansion alloy plate are combined together, that is, bonded together, on their marginal surfaces by butt welding to form a parallel bonded-type bimetal (or a parallel bonded-type trimetal), thereby providing the shadow mask support member. The shadow mask support member thus obtained has a high strength and an excellent thermal deformation resistance, and is far greater in strength than the conventional shadow mask support member formed by a combination of a Fe-36%Ni invar alloy and SUS304.

DESCRIPTION OF THE PREFERRED EMBODIMENTS

EXAMPLE

Figure 1:
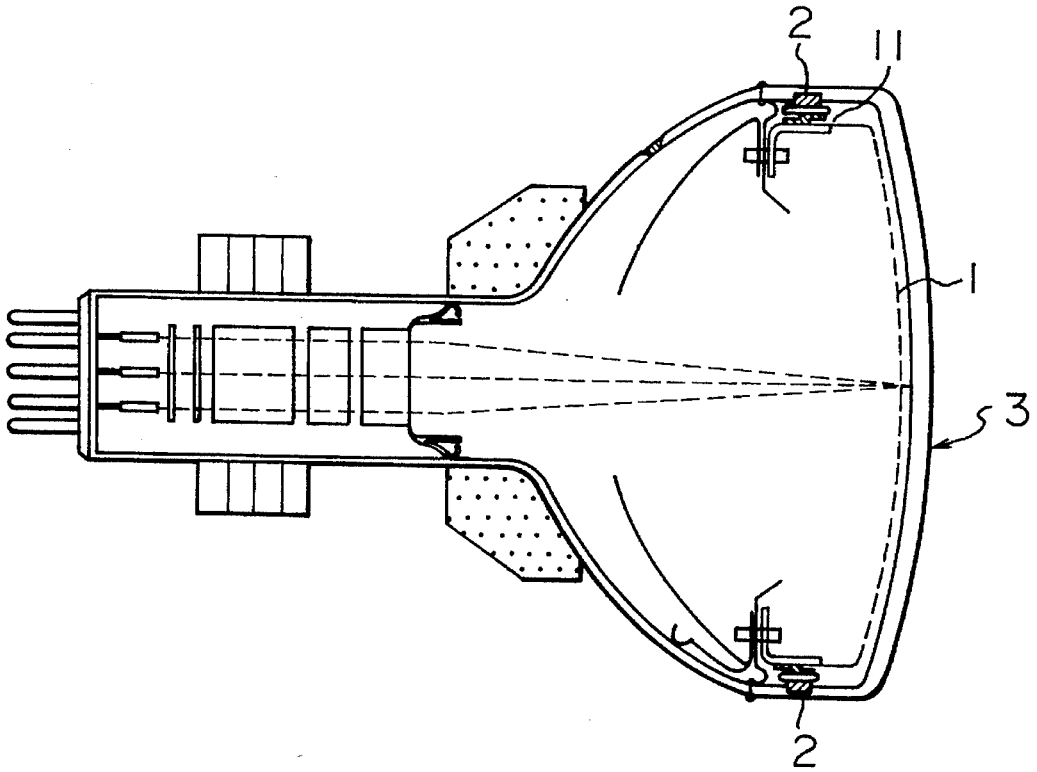
FIG. 1 is a cross sectional view of a color Braun tube having a shadow mask support member embodying the invention.

In FIG. 1 the reference numeral 11 shows a shadow mask support member for supporting a shadow mask 1 through a stud pin 2 which shadow mask is mounted in a color Braun tube 3. The shadow mask support member comprised a low-expansion alloy part 10*a* and a high-expansion alloy part 9*a* both of which were bonded on the marginal surfaces 10' and 9' of the parts by, for example, electron beam welding as shown in FIGS. 2A, 2B, 3A and 3B. Each of low-expansion alloys for a support member of the invention, comparative alloys and a conventional alloy shown in Table 1 was melted in a vacuum induction melting furnace, and was formed into an ingot of 10 kg. Each ingot was formed by hot forging and hot rolling into a plate having a thickness of about 4 mm. Thereafter, the plates were subjected to a solid solution treatment at 980° C. for 30 minutes, and after removing scales, the plates were formed into various thicknesses by cold rolling at a reduction of 15–90%. Then, the thus formed plates were subjected to an aging treatment at 450°–700° C. and then were subjected to a tensile test, a thermal expansion measurement, a thermal deformation test, and an electron beam welding test. In the thermal deformation test, each plate-like test piece, having a width of 10 mm and a length of 100 mm, was fixed in such a manner that it was flexed 5 mm at its central portion in its longitudinal direction, and in this fixed condition the test piece was heated at 450° C. for 1 hour. Then, the test piece, after being cooled, was removed, and the amount of permanent deformation (the amount of change due to the thermal deformation test) of the test piece relative to the condition before flexing was measured, and the thermal deformation resistance was compared and evaluated according to the value of this change amount.

TABLE 1

| Alloy | Chemical Composition (wt %) | | | | | | | | |
|---|---|---|---|---|---|---|---|---|---|
| No. | C | Si | Mn | Ni | Cr | Mo | Co | Fe | Note |
| 1 | 0.28 | 0.20 | 0.21 | 37.2 | — | 2.49 | — | Balance | Low-expansion alloy of the invention |
| 2 | 0.25 | 0.21 | 1.02 | 37.3 | — | 4.00 | — | " | Low-expansion alloy of the invention |
| 3 | 0.26 | 0.22 | 1.06 | 37.1 | — | 4.51 | — | " | Low-expansion alloy |

TABLE 1-continued

| Alloy | Chemical Composition (wt %) | | | | | | | | |
|---|---|---|---|---|---|---|---|---|---|
| No. | C | Si | Mn | Ni | Cr | Mo | Co | Fe | Note |
| | | | | | | | | | of the invention |
| 4 | 0.26 | 0.21 | 1.03 | 37.4 | — | 1.72 | — | " | Low-expansion alloy of the invention |
| 5 | 0.14 | 0.19 | 1.05 | 37.3 | — | 2.64 | — | " | Low-expansion alloy of the invention |
| 6 | 0.25 | 0.22 | 1.01 | 38.8 | — | 2.54 | — | " | Low-expansion alloy of the invention |
| 7 | 0.24 | 0.21 | 1.02 | 37.1 | 2.99 | 2.47 | — | " | Low-expansion alloy of the invention |
| 8 | 0.25 | 0.21 | 1.04 | 37.3 | 5.10 | 2.52 | — | " | Low-expansion alloy of the invention |
| 9 | 0.25 | 0.21 | 1.05 | 37.4 | 7.18 | 2.53 | — | " | Low-expansion alloy of the invention |
| 10 | 0.25 | 0.21 | 1.05 | 37.1 | 3.26 | 4.04 | — | " | Low-expansion alloy of the invention |
| 11 | 0.25 | 0.21 | 1.06 | 37.1 | 5.08 | 4.07 | — | " | Low-expansion alloy of the invention |
| 12 | 0.24 | 0.21 | 1.03 | 32.6 | 2.99 | 4.04 | — | " | Low-expansion alloy of the invention |
| 13 | 0.25 | 0.62 | 1.01 | 33.1 | — | 2.56 | 4.2 | " | Low-expansion alloy of the invention |
| 14 | 0.24 | 0.19 | 0.99 | 30.2 | — | 2.61 | 6.5 | " | Low-expansion alloy of the invention |
| 15 | 0.26 | 0.24 | 1.07 | 32.9 | 3.17 | 2.44 | 4.4 | " | Low-expansion alloy of the invention |
| 16 | 0.25 | 0.23 | 1.02 | 30.6 | 5.19 | 2.62 | 6.3 | " | Low-expansion alloy of the invention |
| 17 | 0.25 | 0.20 | 1.03 | 33.5 | 7.23 | 4.10 | 3.9 | " | Low-expansion alloy of the invention |
| 18 | 0.01 | 0.19 | 0.22 | 37.5 | — | 2.31 | — | Balance | Comparative alloy |
| 19 | 0.24 | 0.18 | 1.03 | 37.1 | — | 8.56 | — | " | " |
| 20 | 0.25 | 0.21 | 1.02 | 27.3 | — | 2.14 | — | " | " |
| 21 | 0.24 | 0.21 | 1.04 | 36.4 | 11.5 | 2.48 | — | " | " |
| 22 | 0.24 | 0.20 | 1.02 | 38.7 | 3.41 | 2.33 | 15.4 | " | " |
| 23 | 0.01 | 0.22 | 0.26 | 36.2 | — | — | — | " | Conventional alloy |

In Table 1, alloy Nos. 1 to 17 indicate the low-expansion alloys for the support member of the invention, alloy Nos. 18 to 22 the comparative alloys, and alloy No. 23 a Fe-36%Ni invar alloy. Test pieces made of the alloys (shown in Table 1), varied in the cold working and the aging temperature, were measured with respect to a tensile strength at a room temperature, an elongation at rupture and an average thermal expansion coefficient at 30°–100° C. Results thereof are shown in Table 2. The amount of change due to the thermal deformation test was measured with respect to the low-expansion alloy plates of the invention, the comparative alloy plates and the conventional alloy plate, and results thereof are shown in Table 3. Further, each of these alloy plates and a plate of SUS304 (one example of a high-expansion plate) were bonded together on their marginal surfaces by electron beam welding, and the welded condition was examined. Results thereof are also shown in Table 3.

Figure 2A:
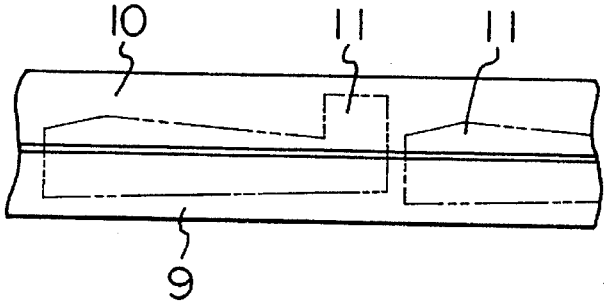
FIGS. 2*a* and 2*b* are a top view and a side view of a bimetal from which the shadow mask support member is formed, respectively.
Figure 2B:
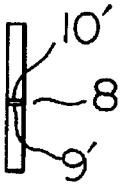
Figure 3A:
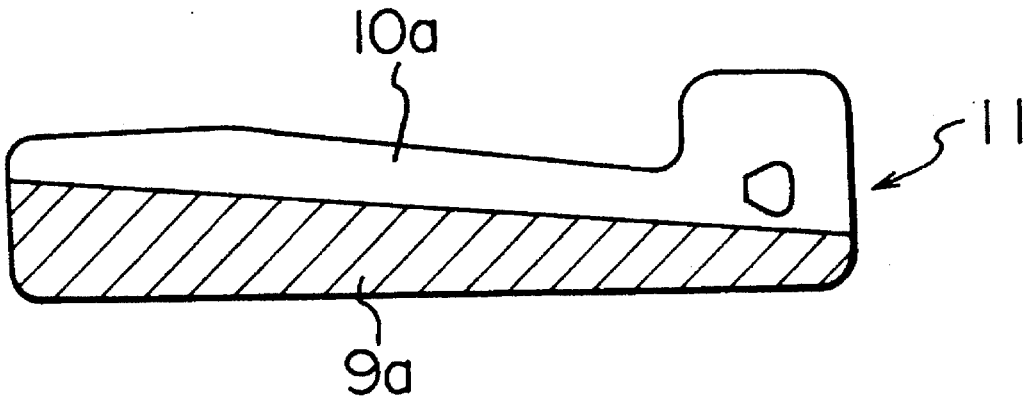
FIGS. 3*a* and 3*b* are a top view and a side view of a shadow mask support member embodying the invention.
Figure 3B:
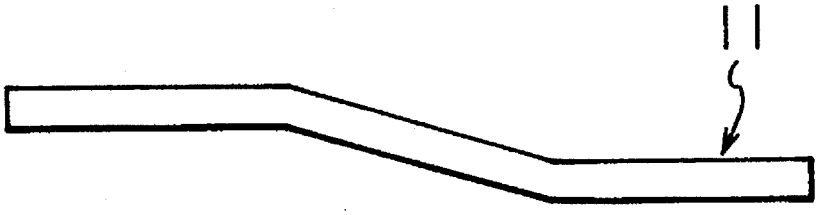

Table 4 shows the composition of examples of high-expansion alloys for forming a high-expansion alloy plate 9 which can be suitably welded to the low-expansion alloy plate 10 of the invention to provide a bimetal, which is then blanked to form the support member 11 as shown in FIGS. 2A and 2B. The tensile strength of these high-expansion alloys, as well as their average thermal expansion coefficient at 30°–100° C., is also shown in Table 4. In Table 4 showing alloy Nos. 24 to 52, alloy Nos. 26 to 29 are high-expansion alloys of the invention as recited in claims 5 and 6, and alloy Nos. 24 and 25 are conventional high-expansion alloys (SUS304). Alloy Nos. 30 to 51 are high-expansion alloys of the invention as recited in claims 7 to 10, and alloy No. 52 is SUS316. By a combination of cold working and an aging treatment, the strength of each of these high-expansion alloys was increased to a level required by a shadow mask support member, and then they were used.

The low-expansion alloy plate of the invention and the high-expansion alloy plate were bonded together on their marginal surfaces by electron beam welding to form a plate-like test piece (having a width of 10 mm and a length of 100 mm) in such a manner that a welded portion was disposed at a central portion of the plate in a widthwise direction. The test pieces thus prepared were subjected to a thermal deformation test according to the same procedure as described above, and also the weldability of these test pieces were evaluated. These results are shown in Table 5.

As shown in Table 2, each of alloy Nos. 1 to 17 of the invention produced by the method of the invention has a tensile strength of not less than 100 kgf/mm$^2$ and a sufficient rupture elongation for practical use. Further, low-expansion alloy Nos. 1 to 6 of the invention having the composition as recited in claim 1, as well as low-expansion alloy Nos. 13 and 14 of the invention having the composition as recited in claim 3, have an average thermal expansion coefficient of not more than $6\times10^{-6}$/° C. at 30°–100° C. Low-expansion alloy Nos. 7 to 12 of the invention having the composition as recited in claim 2, as well as low-expansion alloy Nos. 15 to 17 of the invention having the composition as recited in claim 4, have an average thermal expansion coefficient of not more than $10\times10^{-6}$/° C. at 30°–100° C. Thus, these low-expansion alloys of the invention have a low thermal expansion coefficient.

TABLE 2

| Alloy No. | Cold rolling rate (%) | Aging condi-tion | Tensile strength (kgf/mm$^2$) | Elonga-tion at rupture (%) | Average thermal expansion coefficient $\alpha_{30-100°\ C.}$ ($\times 10^{-6}$/°C.) | Note | |
|---|---|---|---|---|---|---|---|
| 1 | 40 | 550° C. × 1 h, AC | 110.6 | 21.2 | 3.9 | Low-expansion alloy of the invention | Method of the invention |
| | 60 | 550° C. 1 h, AC | 116.1 | 14.3 | 3.8 | Low-expansion alloy of the invention | Method of the invention |
| | 75 | 450° C. × 1 h, AC | 116.9 | 14.1 | 3.3 | Low-expansion alloy of the invention | Method of the invention |
| | " | 500° C. × 1 h, AC | 119.6 | 13.2 | 3.3 | Low-expansion alloy of the invention | Method of the invention |
| | " | 550° C. × 1 h, AC | 117.4 | 13.7 | 3.4 | Low-expansion alloy of the invention | Method of the invention |
| | " | 600° C. × 1 h, AC | 114.3 | 14.9 | 3.4 | Low-expansion alloy of the invention | Method of the invention |
| | " | 650° C. × 1 h, AC | 103.2 | 22.7 | 3.5 | Low-expansion alloy of the invention | Method of the invention |
| | 90 | 550° C. × 1 h, AC | 132.1 | 3.5 | 3.4 | Low-expansion alloy of the invention | Method of the invention |
| 2 | 75 | 550° C. × 1 h, AC | 111.6 | 8.6 | 4.0 | Low-expansion alloy of the invention | Method of the invention |
| 3 | " | 550° C. × 1 h, AC | 122.3 | 6.3 | 4.5 | Low-expansion alloy of the invention | Method of the invention |
| 4 | " | 550° C. × 1 h, AC | 110.8 | 12.1 | 3.2 | Low-expansion alloy of the invention | Method of the invention |
| 5 | " | 550° C. × 1 h, AC | 104.2 | 18.8 | 2.8 | Low-expansion alloy of the invention | Method of the invention |
| 6 | 75 | 550° C. × 1 h, AC | 121.4 | 6.4 | 4.1 | Low-expansion alloy of the invention | Method of the invention |
| 7 | " | 550° C. × 1 h, AC | 120.2 | 9.0 | 5.2 | Low-expansion alloy of the invention | Method of the invention |
| 8 | " | 550° C. × 1 h, AC | 121.8 | 6.4 | 6.4 | Low-expansion alloy of the invention | Method of the invention |
| 9 | " | 550° C. × 1 h, AC | 119.9 | 6.8 | 7.1 | Low-expansion alloy of the invention | Method of the invention |
| 10 | " | 550° C. × 1 h, AC | 118.1 | 6.0 | 5.8 | Low-expansion alloy of the invention | Method of the invention |
| 11 | " | 550° C. × 1 h, AC | 120.2 | 5.8 | 6.4 | Low-expansion alloy of the invention | Method of the invention |
| 12 | " | 550° C. × 1 h, AC | 116.6 | 7.6 | 7.5 | Low-expansion alloy of the invention | Method of the invention |
| 13 | " | 550° C. × 1 h, AC | 125.7 | 5.5 | 3.3 | Low-expansion alloy of the invention | Method of the invention |
| 14 | " | 550° C. × 1 h, AC | 130.4 | 4.2 | 3.2 | Low-expansion alloy of the invention | Method of the invention |
| 15 | " | 550° C. × 1 h, AC | 131.6 | 4.0 | 5.0 | Low-expansion alloy of the invention | Method of the invention |
| 16 | " | 550° C. × 1 h, AC | 130.6 | 4.2 | 6.3 | Low-expansion alloy of the invention | Method of the invention |
| 17 | " | 550° C. × 1 h, AC | 130.1 | 4.1 | 8.1 | Low-expansion alloy of the invention | Method of the invention |
| 1 | 15 | 550° C. × 1 h, AC | 82.1 | 25.8 | 3.1 | Low-expansion alloy of the | Compara-tive |

TABLE 2-continued

| Alloy No. | Cold rolling rate (%) | Aging condition | Tensile strength (kgf/mm$^2$) | Elongation at rupture (%) | Average thermal expansion coefficient $\alpha_{30-100°\,C.}$ ($\times 10^{-6}$/°C.) | Note | |
|---|---|---|---|---|---|---|---|
| | | | | | | invention | method |
| " | 75 | 700° C. × 1 h, AC | 65.4 | 29.4 | 3.7 | Low-expansion alloy of the invention | Comparative method |
| 18 | " | 550° C. × 1 h, AC | 83.8 | 27.3 | 2.4 | Comparative alloy | Method of the invention |
| 19 | 75 | 550° C. × 1 h, AC | 134.6 | 1.1 | 10.1 | Comparative alloy | Method of the invention |
| 20 | " | 550° C. × 1 h, AC | 126.7 | 2.9 | 11.2 | Comparative alloy | Method of the invention |
| 21 | " | 550° C. × 1 h, AC | 124.2 | 5.2 | 10.6 | Comparative alloy | Method of the invention |
| 22 | " | 550° C. × 1 h, AC | 141.6 | 0.9 | 10.3 | Comparative alloy | Method of the invention |
| 23 | " | — | 80.7 | 32.4 | 1.1 | Conventional alloy | Comarattive method |

TABLE 3

| Alloy No. | Cold working rate (%) | Aging condition | Amount of change by thermal deformation test (mm) | Weldability | Note |
|---|---|---|---|---|---|
| 1 | 75 | 550° C. × 1 h, AC | 0.79 | Good | Low-expansion alloy of the invention |
| 2 | " | " | 0.72 | " | Low-expansion alloy of the invention |
| 3 | " | " | 0.68 | " | Low-expansion alloy of the invention |
| 4 | " | " | 0.97 | " | Low-expansion alloy of the invention |
| 5 | " | " | 0.83 | " | Low-expansion alloy of the invention |
| 6 | " | " | 0.70 | " | Low-expansion alloy of the invention |
| 7 | " | " | 0.25 | " | Low-expansion alloy of the invention |
| 8 | " | " | 0.71 | " | Low-expansion alloy of the invention |
| 9 | " | " | 0.58 | " | Low-expansion alloy of the invention |
| 10 | " | " | 0.50 | " | Low-expansion alloy of the invention |
| 11 | " | " | 0.56 | " | Low-expansion alloy of the invention |
| 12 | " | " | 0.56 | " | Low-expansion alloy of the invention |
| 13 | " | " | 0.71 | " | Low-expansion alloy of the invention |
| 14 | " | " | 0.68 | " | Low-expansion alloy of the invention |
| 15 | " | " | 0.57 | " | Low-expansion alloy of the invention |
| 16 | " | " | 0.55 | " | Low-expansion alloy of the invention |
| 17 | " | " | 0.54 | " | Low-expansion alloy of the invention |
| 18 | 75 | 550° C. × 1 h, AC | 1.51 | Good | Comparative alloy |
| 19 | " | " | 0.48 | " | " |
| 20 | " | " | 0.47 | " | " |
| 21 | " | " | 0.50 | " | " |
| 22 | " | " | 0.49 | " | " |
| 23 | " | " | 2.61 | " | Convention alloy |

TABLE 4

| Alloy | Chemical composition of high-expansion alloys of the invention (wt %) | | | | | | | | | | | Tesile Strength | Average thermal expansion coefficient |
|---|---|---|---|---|---|---|---|---|---|---|---|---|---|
| No. | C | Si | Mn | Ni | Cr | Mo | W | V | Nb | N | Fe | (kgf/mm$^2$) | $\alpha_{30-100°\ C.}$ ($\times 10^{-6}$/°C.) |
| 24 | 0.04 | 0.6 | 1.7 | 9.5 | 18.8 | — | — | — | — | — | Balance | 125.4 | 15.1 |
| 25 | 0.04 | 0.5 | 1.8 | 9.2 | 18.9 | — | — | — | — | 0.10 | " | 130.3 | 15.2 |
| 26 | 0.10 | 0.6 | 13.7 | 4.3 | 16.4 | — | — | — | — | 0.29 | " | 151.0 | 15.5 |
| 27 | 0.09 | 0.5 | 14.3 | 3.9 | 15.9 | — | — | 0.4 | — | 0.31 | " | 151.2 | 15.6 |
| 28 | 0.08 | 0.4 | 13.8 | 4.1 | 14.9 | 2.0 | — | — | — | 0.28 | " | 147.6 | 15.1 |
| 29 | 0.11 | 0.5 | 13.9 | 4.2 | 15.2 | 1.6 | — | 0.3 | — | 0.29 | " | 149.3 | 15.2 |
| 30 | 0.72 | 0.14 | 5.46 | 9.44 | — | 1.0 | — | 0.73 | — | — | " | 160.2 | 18.3 |
| 31 | 0.74 | 0.11 | 5.44 | 9.47 | 1.1 | 1.2 | — | 0.72 | — | 0.01 | " | 160.7 | 18.2 |
| 32 | 0.70 | 0.21 | 5.43 | 9.28 | 3.1 | — | — | 0.74 | — | 0.04 | " | 166.3 | 18.1 |
| 33 | 0.67 | 0.23 | 5.47 | 9.35 | 5.1 | — | — | 0.38 | — | 0.03 | " | 161.4 | 18.3 |
| 34 | 0.73 | 0.15 | 5.43 | 9.39 | — | 1.2 | | 0.72 | — | 0.04 | " | 160.8 | 18.2 |
| 35 | 0.75 | 0.31 | 5.51 | 9.44 | — | — | 2.1 | 0.76 | — | 0.03 | " | 159.2 | 18.2 |
| 36 | 0.72 | 0.24 | 5.38 | 9.52 | 1.2 | — | 2.0 | 0.73 | — | 0.02 | " | 162.9 | 18.1 |
| 37 | 0.75 | 0.12 | 5.63 | 9.43 | — | 1.1 | 1.2 | 0.72 | — | 0.01 | " | 161.2 | 18.0 |
| 38 | 0.74 | 0.12 | 5.43 | 9.61 | 1.2 | 1.1 | 1.1 | 0.71 | — | 0.02 | " | 163.8 | 18.1 |
| 39 | 0.73 | 0.23 | 5.59 | 9.32 | 1.5 | — | — | 0.74 | — | — | " | 160.8 | 17.9 |
| 40 | 0.73 | 0.26 | 5.52 | 9.77 | — | — | 2.2 | 0.76 | — | — | " | 161.7 | 17.9 |
| 41 | 0.75 | 0.14 | 5.46 | 9.61 | 1.4 | 1.0 | — | 0.75 | — | — | " | 163.1 | 18.1 |

| Alloy | Chemical composition of high-expansion alloys of the invention (wt %) | | | | | | | | | | | Tesile Strength | Average thermal expansion coefficient |
|---|---|---|---|---|---|---|---|---|---|---|---|---|---|
| No. | C | Si | Mn | Ni | Cr | Mo | W | V | Nb | N | Fe | (kgf/mm$^2$) | $\alpha_{30-100°\ C.}$ ($\times 10^{-6}$/°C.) |
| 42 | 0.76 | 0.11 | 5.42 | 9.55 | 2.6 | 1.3 | — | 0.73 | — | — | Balance | 158.9 | 18.3 |
| 43 | 0.74 | 0.19 | 5.41 | 9.47 | — | 1.2 | 1.3 | 0.77 | — | — | " | 159.9 | 18.2 |
| 44 | 0.74 | 0.13 | 5.52 | 9.42 | 1.5 | 1.3 | 1.2 | 0.71 | — | — | " | 162.1 | 18.0 |
| 45 | 0.73 | 0.13 | 5.33 | 9.48 | 1.2 | 1.1 | — | 0.72 | 0.11 | — | " | 157.9 | 18.1 |
| 46 | 0.75 | 0.24 | 5.48 | 9.59 | 1.0 | 1.2 | — | 0.73 | 0.20 | 0.04 | " | 161.6 | 18.2 |
| 47 | 0.79 | 0.12 | 5.38 | 9.67 | 1.6 | — | 1.6 | 0.70 | 0.14 | — | " | 157.2 | 18.0 |
| 48 | 0.72 | 0.19 | 5.56 | 9.31 | 0.9 | — | 2.2 | 0.77 | 0.09 | 0.03 | " | 160.4 | 18.1 |
| 49 | 0.41 | 0.21 | 5.62 | 13.73 | 1.3 | 1.5 | — | 0.37 | — | 0.02 | " | 146.7 | 17.9 |
| 50 | 0.70 | 0.14 | 5.43 | 17.48 | 3.6 | 1.3 | — | 0.67 | — | — | " | 147.2 | 17.6 |
| 51 | 0.71 | 0.18 | 8.92 | 9.33 | 2.1 | — | 1.8 | 0.69 | — | — | " | 161.3 | 17.4 |
| 52 | 0.04 | 0.6 | 1.8 | 12.7 | 16.5 | 2.1 | — | — | — | — | " | 121.8 | 15.2 |

TABLE 5

| Low-expansion alloy | High-exapnsion alloy | Amount of change by thermal deformation test (mm) | Weld-ability |
|---|---|---|---|
| No. 1 | No. 24 | 1.24 | Good |
| " | 26 | 0.86 | " |
| " | 27 | 0.85 | " |
| " | 28 | 0.77 | " |
| " | 30 | 0.91 | " |
| " | 31 | 0.63 | " |
| " | 32 | 0.72 | " |
| " | 33 | 0.65 | " |
| " | 34 | 0.64 | " |
| " | 35 | 0.67 | " |
| " | 36 | 0.59 | " |
| " | 37 | 0.60 | " |
| " | 38 | 0.55 | " |
| " | 39 | 0.81 | " |
| " | 40 | 0.78 | " |
| " | 41 | 0.64 | " |
| " | 42 | 0.56 | " |
| " | 43 | 0.67 | " |
| " | 44 | 0.58 | " |
| " | 45 | 0.61 | " |
| " | 46 | 0.62 | " |
| " | 47 | 0.65 | " |
| " | 48 | 0.59 | " |
| " | 49 | 0.73 | " |
| " | 50 | 0.58 | " |
| " | 51 | 0.74 | " |
| 7 | 26 | 0.58 | " |

TABLE 5-continued

| Low-expansion alloy | High-exapnsion alloy | Amount of change by thermal deformation test (mm) | Weld-ability |
|---|---|---|---|
| 14 | 26 | 0.79 | " |
| 16 | 26 | 0.73 | " |
| Fe-36Ni | SUS304 | 2.22 | " |

On the other hand, as shown in Table 2, comparative alloy Nos. 18 to 22 are low in tensile strength or high in average thermal expansion coefficient at 30°–100° C. even though the method of the invention is used. Thus, either the tensile strength or this average thermal expansion coefficient is outside the range of the invention. Conventional alloy No. 23 is low in thermal expansion coefficient at 30°–100° C., but is low in tensile strength, and therefore is outside the range of the invention. If the low-expansion alloys of the invention are cold worked at a reduction lower than that of the method of the invention, or are subjected to the aging treatment at a temperature higher than that of the method of the invention, the tensile strength is low, and therefore is outside the range of the invention, as shown in Table 2.

As shown in Table 3, the low-expansion alloys of the invention are far lower in the amount of change due to the thermal deformation test than comparative alloy No. 18 with a low C content and conventional alloy No. 23 with a low C content not containing Cr and Mo, and therefore have a good thermal deformation resistance.

As shown in Table 3, the electron beam weldability of the low-expansion alloys of the invention is as good as that of the comparative alloys and the conventional alloy, and these low-expansion alloys of the invention had no problem with weldability in the production of the parallel bonded-type bimetal, so that the shadow mask support member could be produced satisfactorily.

The average thermal expansion coefficient of each of the high-expansion alloys shown in Table 4 is not less than $14\times10^{-6}$/° C. at 30°–100° C., and particularly alloy Nos. 30 to 51 satisfy the value of not less than $16\times10^{-6}$/° C. at 30°–100° C. Also, these high-expansion alloys satisfy a tensile strength of not less than 110 kgf/mm$^2$ at a room temperature. As shown in Table 5, the support members, each formed by welding the low-expansion alloy plate of the invention and the high-expansion alloy plate of Table 4 together, are far superior to the conventional support member formed by combining a Fe-36%Ni invar alloy and SUS304 together. Further, the support members, each formed by welding the low-expansion alloy plate of the invention and the high-expansion alloy plate (Nos. 26 to 51 as recited in claims 5 to 10) together, is superior in thermal deformation resistance to the support member formed by welding the low-expansion alloy plate of the invention and SUS304 (No. 24 in Table 4) together.

As described above, the shadow mask support member, formed by combining the low-expansion alloy plate, having a high strength and an excellent thermal deformation resistance, with the high-expansion alloy plate, has a high strength and an excellent thermal deformation resistance, and this support member can greatly contribute to a large-size design of a Braun tube and a flat face design thereof.

What is claimed is:

1. A shadow mask support member comprising a high-strength, low-expansion alloy plate, and a high-expansion alloy plate which are bonded together on their marginal surfaces, said low-expansion alloy plate having an excellent resistance to thermal deformation, said low-expansion alloy plate consisting essentially, by weight, of 0.1–0.5% C, 1.0% or less Si, 2.0% or less Mn, 30–40% Ni, 1.0–5.0% Mo and the balance Fe and incidental impurities, said low-expansion alloy plate having an average thermal expansion coefficient of $6\times10^{-6}$/° C. or less at 30°–100° C. and a tensile strength of 100 kgf/mm$^2$ or greater at a room temperature, and said high-expansion alloy plate having an average thermal expansion coefficient of $14\times10^{-6}$/° C. or greater at 30°–100° C. and a tensile strength of 110 kgf/mm$^2$ or greater at a room temperature.

2. A shadow mask support member comprising a high-strength, low-expansion alloy plate, and a high-expansion alloy plate which are bonded together on their marginal surfaces, said low-expansion alloy plate having an excellent resistance to thermal deformation, said low-expansion alloy plate consisting essentially, by weight, or 0.1–0.5% C, 1.0% or less Si, 2.0% or less Mn, 10.0% or less Cr, 30–40% Ni, 1.0–5.0% Mo and the balance Fe and incidental impurities, said low-expansion alloy plate having an average thermal expansion coefficient of $10\times10^{-6}$/° C. or less at 30–100% and a tensile strength of 100 kgf/mm$^2$ or greater at a room temperature, and said high-expansion alloy plate having an average thermal expansion coefficient of $14\times10^{-6}$/° C. or greater at 30°–100° C. and a tensile strength of 110 kgf/mm$^2$ or greater at a room temperature.

3. A shadow mask support member comprising a high-strength, low-expansion alloy plate, and a high-expansion alloy plate which are bonded together on their marginal surfaces, said low-expansion alloy plate having an excellent resistance to thermal deformation, said low-expansion alloy plate consisting essentially, by weight, of 0.1–0.5% C, 1.0% or less Si, 2.0% or less Mn, 30–40% Ni, 10.0% or less Co, 1.0–5.0% Mo and the balance Fe and incidental impurities, Ni+Co being 30–40%, said low-expansion alloy plate having an average thermal expansion coefficient of $6\times10^{-6}$/° C. or less at 30°–100° C. and a tensile strength of 100 kgf/mm$^2$ or greater at a room temperature, and said high-expansion alloy plate having an average thermal expansion coefficient of $14\times10^{-6}$/° C. or less at 30°–100° C. and a tensile strength of 110 kgf/mm$^2$ or greater at a room temperature.

4. A shadow mask support member comprising a high-strength, low-expansion alloy plate, and a high-expansion alloy plate which are bonded together on their marginal surfaces, said low-expansion alloy plate having an excellent resistance to thermal deformation, said low-expansion alloy plate consisting essentially, by weight, of 0.1–0.5% C, 1.0% or less Si, 2.0% or less Mn, 10.0% or less Cr, 30–40% Ni, 10.0% or less Co, 1.0–5.0% Mo and the balance Fe and incidental impurities, Ni+Co being 30–40%, said low-expansion alloy plate having an average thermal expansion coefficient of $10\times10^{-6}$/° C. or less at 30°–100° C. and a tensile strength of 100 kgf/mm$^2$ kgf/mm$^2$ or greater at a room temperature, and said high-expansion alloy plate having an average thermal expansion coefficient of $14\times 10^{-6}$/° C. or greater at 30°–100° C. and a tensile strength of 110 kgf/mm$^2$ or greater at room temperature.

5. A shadow mask support member comprising the high-strength, low-expansion alloy plate as defined in any one of claims 1 to 4, and a high-expansion alloy plate which are bonded together on their marginal surfaces, said high-expansion alloy plate consisting essentially, by weight, of 0.2% or less C, or less 1.0% Si, 10–20% Mn, 10–20% Cr, 2–10% Ni, 0.4% or less N and the balance Fe and incidental impurities, and said high-expansion alloy plate having an average thermal expansion coefficient of $14\times 10^{-6}$/° C. or greater at 30°–100° C. and a tensile strength of 110 kgf/mm$^2$ or greater at a room temperature.

6. A shadow mask support member comprising the high-strength, low-expansion alloy plate as defined in any one of claims 1 to 4, and a high-expansion alloy plate which are bonded together on their marginal surfaces, said high-expansion alloy plate consisting essentially, by weight, or 0.2% or less C, 1.0% or less Si, 10–20% Mn, 10–20% Cr, 2–10% Ni, 0.4% or less N, at least one selected from the group consisting of 3.0% or less Mo and 1.0% or less V, and the balance Fe and incidental impurities, and said high-expansion alloy plate having an average thermal expansion coefficient of $14\times10^{-6}$/° C. or greater at 30°–100° C. and a tensile strength of 110 kgf/mm$^2$ or greater at a room temperature.

7. A shadow mask support member comprising the high-strength, low-expansion alloy plate as defined in any one of claims 1 to 4, and a high-expansion alloy plate which are bonded together on their marginal surfaces, said high-expansion alloy plate consisting essentially, by weight, of 0.2–1.0% C, 1.0% or less Si, 2–10% Mn, 8–20% Ni, 0.1–1.5% V, at least one selected from the group consisting of 6.0% or less Cr, 4% Mo or less and 4% or less W, and the balance Fe and incidental impurities, and said high-expansion alloy plate having an average thermal expansion coefficient of $16\times10^{-6}$/° C. or greater at 30°–100° C. and a tensile strength of 110 kgf/mm$^2$ or greater at a room temperature.

8. A shadow mask support member comprising the high-strength, low-expansion alloy plate as defined in any one of claims 1 to 4, and a high-expansion alloy plate which are bonded together on their marginal surfaces, said high-expansion alloy plate consisting essentially, by weight, of 0.2–1.0% C, 1.0% or less Si, 2–10% Mn, 8–20% Ni, 0.1–1.5% V, 0.1% or less N, at least one selected from the group consisting of 6.0% or less Cr, 4% or less Mo and 4% or less W, and the balance Fe and incidental impurities, and said high-expansion alloy plate having an average thermal expansion coefficient of $16\times10^{-6}$/° C. or greater at 30°–100° C. and a tensile strength of 110 kgf/mm$^2$ or greater at a room temperature.

9. A shadow mask support member comprising the high-strength, low-expansion alloy plate as defined in any one of claims 1 to 4, and a high-expansion alloy plate which are bonded together on their marginal surfaces, said high-expansion alloy plate consisting essentially, by weight, of 0.2–1.0% C, 1.0% or less Si, 2–10% Mn, 8–20% Ni, 0.1–1.5% V, 0.5% or less Nb, at least one selected from the group consisting of 6.0% or less Cr, 4% or less Mo and 4% or less W, and the balance Fe and incidental impurities, and said high-expansion alloy plate having an average thermal expansion coefficient of $16\times10^{-6}$/° C. or greater at 30°–100° C. and a tensile strength of 110 kgf/mm$^2$ or greater at a room temperature.

10. A shadow mask support member comprising the high-strength, low-expansion alloy plate as defined in any one of claims 1 to 4, and a high-expansion alloy plate which are bonded together on their marginal surfaces, said high-expansion alloy plate consisting essentially, by weight, of 0.2–1.0% C, 1.0% or less Si, 2–10% Mn, 8–20% Ni, 0.1–1.5% V, 0.5% or less Nb, 0.1% or less N, at least one selected from the group consisting of 6.0% or less Cr, 4% or less Mo and 4% or less W, and the balance Fe and incidental impurities, and said high-expansion alloy plate having an average thermal expansion coefficient of $16\times10^{-6}$/° C. or greater at 30°–100° C. and a tensile strength of 110 kgf/mm$^2$ or greater at a room temperature.

11. A method of producing a shadow mask support member having an excellent resistance to thermal deformation, comprising the steps of:

cold working a high-strength, low-expansion alloy plate as defined in any one of claims 1 to 4 at a reduction of 40% or greater, and subsequently subjecting said low-expansion alloy plate to an aging treatment at 650° C. or less; and subsequently bonding said low-expansion alloy plate to a high-expansion alloy plate on their marginal surfaces.

* * * * *